US007898393B2

(12) United States Patent
McMillan et al.

(10) Patent No.: US 7,898,393 B2
(45) Date of Patent: Mar. 1, 2011

(54) WALL-MOUNTED SCOREBOARD

(75) Inventors: Kris Phillip McMillan, Yorkville, IL (US); Mario Tinoco, Yorkville, IL (US)

(73) Assignee: Skybox Scoreboards Inc., Yorkville, IL (US)

( * ) Notice: Subject to any disclaimer, the term of this patent is extended or adjusted under 35 U.S.C. 154(b) by 299 days.

(21) Appl. No.: 11/827,935

(22) Filed: Jul. 13, 2007

(65) Prior Publication Data

US 2008/0088421 A1 Apr. 17, 2008

Related U.S. Application Data

(60) Provisional application No. 60/831,027, filed on Jul. 14, 2006.

(51) Int. Cl.
*A63D 5/04* (2006.01)
*H05B 39/00* (2006.01)
*A63F 9/24* (2006.01)

(52) U.S. Cl. ..... 340/323 R; 340/539.1; 340/332; 463/1; 463/3; 463/4; 463/46

(58) Field of Classification Search ..... None
See application file for complete search history.

(56) References Cited

U.S. PATENT DOCUMENTS

| | | | | |
|---|---|---|---|---|
| D159,315 | S | 7/1950 | Beach | |
| D159,316 | S | 7/1950 | Beach | |
| 3,140,476 | A | 7/1964 | Zoller, Jr. et al. | |
| 3,291,975 | A | 12/1966 | McCullough et al. | |
| 3,981,002 | A | 9/1976 | Gardner | |
| 4,263,736 | A * | 4/1981 | Beierwaltes et al. | 40/452 |
| D265,892 | S | 8/1982 | Gebhardt et al. | |
| 4,751,506 | A | 6/1988 | Brown | |
| 5,294,913 | A * | 3/1994 | Mower et al. | 340/323 R |
| 5,418,517 | A * | 5/1995 | Matherne et al. | 340/323 R |
| 5,894,261 | A * | 4/1999 | Green | 340/323 R |
| 5,898,587 | A | 4/1999 | Bell et al. | |
| 6,980,113 | B1 * | 12/2005 | Uehran | 340/573.1 |
| 7,209,958 | B2 * | 4/2007 | Crookham et al. | 709/217 |
| 2002/0044045 | A1 | 4/2002 | Crookham et al. | |
| 2005/0138106 | A1 | 6/2005 | Crookham et al. | |
| 2006/0244572 | A1 * | 11/2006 | Carr et al. | 340/323 R |

* cited by examiner

*Primary Examiner*—Julie Lieu
(74) *Attorney, Agent, or Firm*—Erickson Law Group, PC

(57) ABSTRACT

A wall mounted scoreboard is sized and configured to be used in a home or commercial establishment. The scoreboard includes a back cover, a cover panel and a display panel. The back cover has a front open face and the cover panel is applied over the front face of the back cover. The display panel is interposed between the back cover and the cover panel. The display panel has changeable indicators arranged in information blocks that are in registry with the windows in the cover panel. The cover panel includes graphics which display a designator for each information block, the designators corresponding to game data. The scoreboard includes a wireless receiver and a control. The wireless receiver receives status information broadcast wirelessly from a game in progress and the control causes the display panel to display the status information thereon within the information blocks.

10 Claims, 8 Drawing Sheets

WALL-MOUNTED SCOREBOARD

This application claims the benefit of U.S. Provisional Application Ser. No. 60/831,027 filed Jul. 14, 2006.

TECHNICAL FIELD OF THE INVENTION

The invention pertains to scoreboards, particularly to a wall mounted scoreboard that is usable in a home or business establishment.

BACKGROUND OF THE INVENTION

Many of today's popular spectator sports are closely monitored by dedicated fans. Fans are not only interested in the score of the game but are also interested in a great number of details and data that occur during the game.

There are situations when even dedicated fans cannot watch the game or listen to the game on the radio because the fan must attend to other matters where the action and sound of the game would distract the fan from full attention to these other matters. These other matters could be business matters, family matters or social matters. Nonetheless, the fan still desires to be instantly informed of the current status of the ongoing game.

Some systems do exist that, under the right circumstances, can quickly inform the dedicated fan the score of his favorite sports team. However these systems have drawbacks or limitations. Switching on a sports channel on television can result in a wait for a particular game score and details to be reported, or a wait for a commercial to end. Accessing the Internet to ascertain the score and details may be delayed by the need to boot-up the computer or wait for an Internet connection. Radio broadcasts suffered the same immediacy constraints and limitations as television broadcasts.

Additionally, retrieving game information from some of these systems may not be appropriate or practical in some settings and during some activities. Obtaining audible scores from television or radio in a loud bar or restaurant is difficult. Additionally, at home, entertaining visitors or spending time with family can be interrupted by the time taken by the fan to access the internet or turn on the television or radio to obtain the game score. Also, at home the fan may not be able to watch or listen to the game because of the need to watch a different program with the fan's spouse who may not care to watch or hear the game. In a workplace environment, listening or watching a game or sports channel can be discouraged by an employer as being a distraction to the fan or others working near the fan.

The present inventors have recognized that the need exists for a display device that can inform a user instantly the current status of the game of interest without distracting from the current activities of the user.

The present inventors have recognized that the need exists for a display device that is usable to communicate the current status of the game of interest, even in a loud and distracting environment.

The present inventors have recognized that the need exists for a display device that is usable to communicate the current status of the game of interest, without generating sound to distract others not interested in the particular game.

SUMMARY OF THE INVENTION

The present invention provides a wall mounted scoreboard sized and configured to be used in a home or commercial establishment. The scoreboard includes a back cover, a cover panel and a display panel. The back cover has a front open face and the cover panel is applied over the front face of the back cover. The display panel is interposed between the back cover and the cover panel. The display panel has changeable indicators such as LED or LCD displays arranged in information blocks, wherein the cover panel includes openings that are in registry with the information blocks. The cover panel includes graphics which display a designator for each information block, the designators corresponding to game data. A front frame can be used to retain the cover panel in front of the display panel.

The scoreboard includes a receiver and a control. The receiver receives real time game status information broadcast continuously or at regular intervals from a remote provider for a game in progress and the control causes the display panel to display the status information thereon within the information blocks.

The broadcast is preferably a wireless transmission, such as a radio frequency transmission, cellular phone transmission or a satellite transmission. The signal can be transmitted via the use of satellite, radio transmission towers, repeaters, or any other type of transmitter or antenna. However, the broadcast could also be a wired transmission such as from a cable-television line, a telephone line, other Internet-type transmission line, or the like.

According to an exemplary embodiment, the game is a baseball game, and the information blocks display information such as team identifiers, the current score, balls, strikes, outs, and runners on base.

According to an exemplary embodiment the game is a football game, and the information blocks display information such as team identifiers, ball location, the current down, yards-to-go, team in possession of the ball, and score.

Preferably, the cover panel is removable and replaceable with a different cover panel having graphics for a different team or for a different sport. In this way, one scoreboard can be used year-round for different seasonal sports or for different teams.

Preferably the back cover comprises mounting holes for hanging the scoreboard on a wall.

The present invention provides an attractive, compact scoreboard that is continuously or intermittently updated to display the current status of the game, wherein the scoreboard can be wall mounted within a home or business establishment. Preferably, the scoreboard is remotely updated by wireless transmission from a remote provider. The wall mounted scoreboard has a plurality of display elements that can signify the current score of the game as well as detailed game information.

The remote provider can charge a monthly access fee or subscription fee, or the fee can be a one-time charge when the scoreboard is purchased. Alternately, the cost of the remote service provider can be borne by advertising displayed on the scoreboard.

The scoreboard can be provided with a space for advertising. This advertising can be permanently applied to an outer surface of the scoreboard or could be changeable. Accordingly, the display panel can have one or more information blocks that can display advertising. The advertising space can be leased from the remote service provider. The display panel can present the advertising for example as a stationary image, or moving letter ticker tape style display, or an animation.

The present invention provides a wall mounted scoreboard that is configured to be compatible with a plurality of sports wherein a removable and replaceable cover can be applied over the scoreboard to change the designation of the information blocks that are provided by the scoreboard.

The present invention provides a wall mounted scoreboard that can display a selected game from a plurality of games. The present invention provides a mechanism wherein the user can scroll through the plurality of games to receive the current status of a selected game.

The present invention provides a wall mounted scoreboard that is attractive and can be a replica of a scoreboard found at the stadium of the fan's favorite team.

The present invention provides a wall mounted scoreboard that is particularly useful in the home, in a game room, in an office, in a sports bar, or in a casino.

According to the present invention, a dedicated fan can instantly glance at the wall mounted, wirelessly updated scoreboard and observe the current status of the game involving his favorite team. Even when entertaining guests, the conversation and activities are not interrupted to determine the status of the game because the dedicated fan need only glance up at the wall to know the current status of the game. In a loud atmosphere of a sports bar, the current status of the game can be quickly ascertained without straining the eyes or ears or attempting to hush the patrons of the bar. In the office or business establishment setting, unlike a radio or television broadcast, the current status of the game can be quickly ascertained without the need to interrupt productive activities or disturb the quiet of the office or business establishment. The wall mounted scoreboard quietly and immediately transmits the needed information to the dedicated fan.

The wall mounted scoreboard displays in real-time any or all professional, college or other sports scores using LED, LCD or other type number and letter displays. The wall mounted scoreboard can receive multiple score updates for multiple games depending on the size and variation of the scoreboard. For baseball, the wall mounted scoreboard can also display player statistics, balls, strikes, outs, runners on base. For football the wall mounted scoreboard can display the quarter, down, time remaining, yards to go, and ball possession. The cover panel can also allocate some space on the scoreboard for an advertising display. The advertising display can be a window in registry with an advertising information block on the display panel. The advertising display can be changed wirelessly by the provider.

The scoreboard uses wireless technology over an expanded broadcast area via cellular or satellite technology. The scoreboard can be battery-powered or supplied with power from an electric power outlet.

Numerous other advantages and features of the present invention will be become readily apparent from the following detailed description of the invention and the embodiments thereof, and from the accompanying drawings.

DETAILED DESCRIPTION OF THE PREFERRED EMBODIMENT

Figure 1:
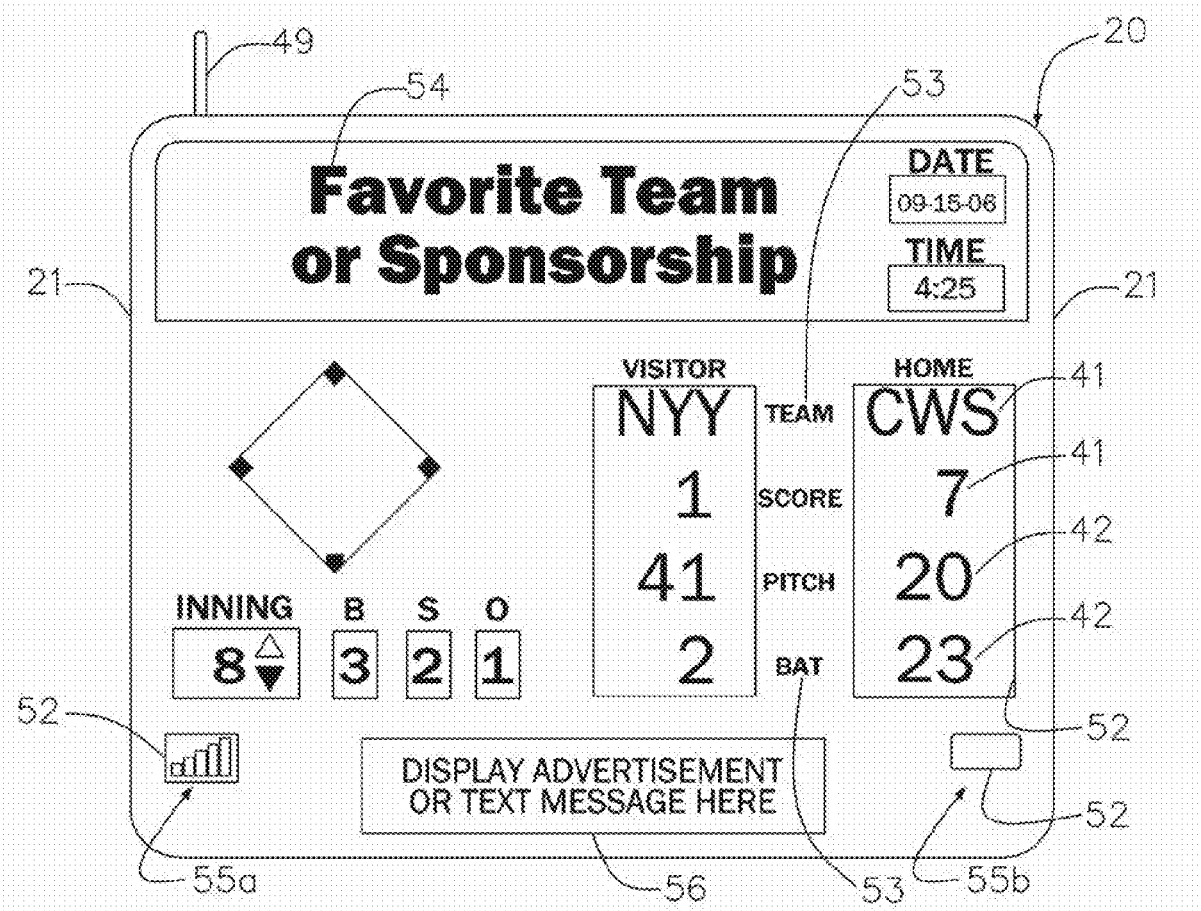
FIG. 1 is an elevation view of a wall mounted wireless scoreboard according to the invention having a baseball display.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIGS. 1 and 3-5 illustrate a wall mounted scoreboard 20 of the present invention. The scoreboard includes a case 21 that is substantially rectangular and comprises a length L of about 20 inches and a height H of about 16 inches. The case includes a back cover 26, a display panel 28, a display cover panel 32 in one or more parts, and a cover frame 40. The display panel 28 provides LED or LCD elements 41 arranged in information blocks 42. The back cover houses an electronic control 44 (shown schematically) that controls the display panel 28 to output information via the information blocks 42. A wireless receiver 48 (shown schematically) is mounted in the back cover 26 and receives real-time game information from a wireless remote provider via an antenna 49. The receiver 48 communicates broadcast game information to the control 44.

A pair of mounted holes 50*a*, 50*b* are provided through the back cover 26 for mounting the scoreboard 20 to a wall using wall fasteners or hooks.

The cover panel 32 includes a plurality of open windows 52 that reveal the information blocks 42 through the cover panel 32 and include graphics 53 applied to the cover panel 32 that define the subject matter of the respective information blocks to the observer. Additionally, the cover panel 32 can have indicia 54 of the user's favorite sports team, or advertising information. The cover panel is replaceable so that the scoreboard can be used for different teams corresponding to different favorite teams or different sports. The cover frame 40 includes windows 51 to allow graphics 53, 54 on the cover panel 32 and information blocks 42 on the display panel 28 to be visible through a front of the cover frame 40. The scoreboard can be assembled by a snap fit or a screw fastener connection between the front frame 40 and the back cover 26.

For example, the information blocks 42 shown in FIG. 1 are configured for baseball, and include the date and time, a simulated diamond showing men on base, the inning, the current ball, strike and outs count, the abbreviation for each team name, the current score for each team, the uniform numbers of the current pitchers and uniform numbers of the current batter. Also, along a bottom of the display panel 28 is a signal bar indication block 55*a* to indicate to the user the signal strength of the wireless service. A light indicator block 55*b* can also indicate active transmission of updates.

A message block 56 along a bottom of the frame 40 can be allocated for advertising or a text message. The message block 56 can be an information block 42 displayed by the display panel 28 and visible through a window 52 through the cover panel 32 and a window 51 through the frame 40. In this way, the message block 56 can be changed periodically by the remote provider and advertising can be sold. The message block 56 can display advertising that is paid by an advertiser to the remote service provider. The message block 56 can display advertising that is sent real time by the remote service provider or that is uploaded into a memory within the control 44 of the scoreboard. The message block 56 can present the advertising for example as a stationary image, a moving letter ticker tape style display, an animation, or other type advertising. Alternately, the message block can be a permanent graphic on the cover frame 40.

Figure 2:
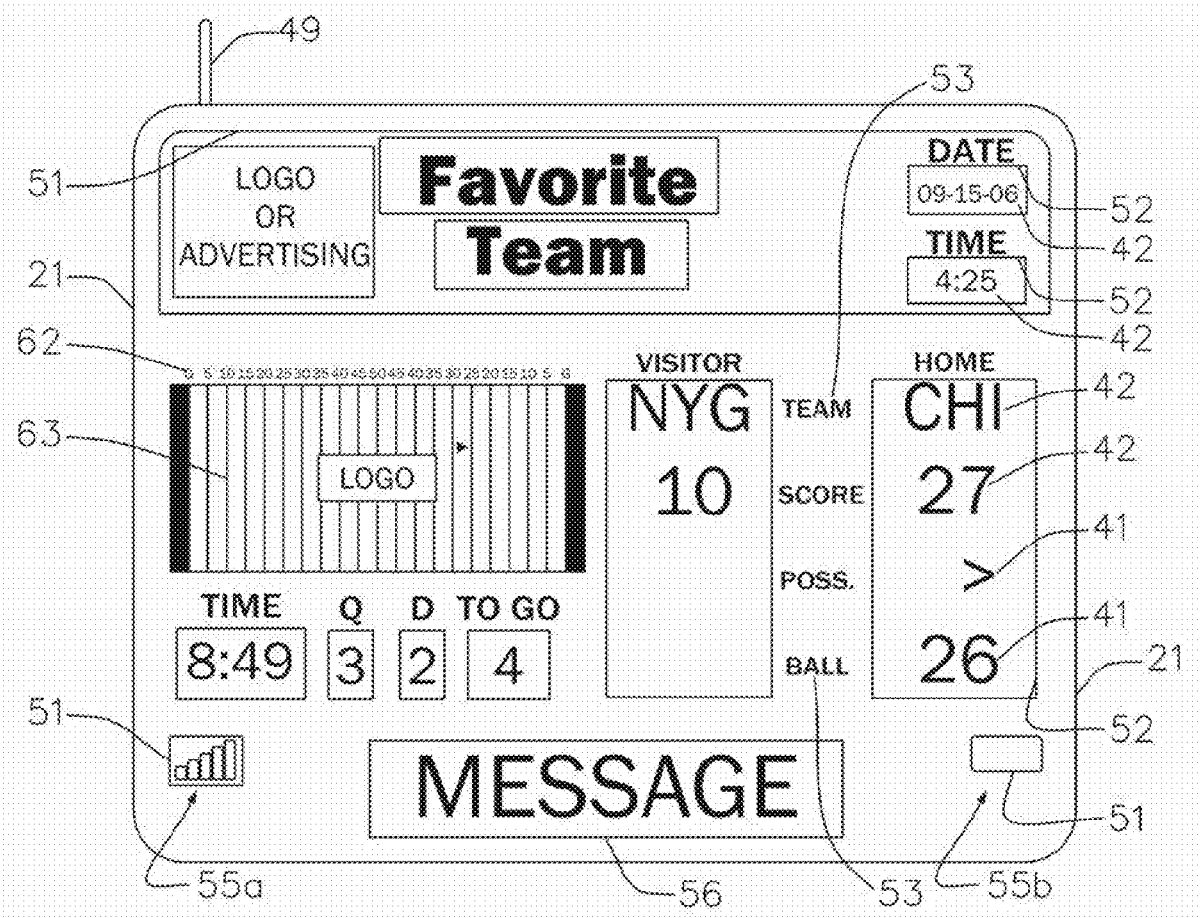
FIG. 2 is an elevation view of the wall mounted scoreboard of FIG. 1 modified to have a display panel for a football game.

FIG. 2 shows the scoreboard 20 outfitted with a different cover panel 62 for football sandwiched between the frame 40 and the display panel 28. A simulated football field information block 63 shows the position of the football on the field. Time, quarter, current down, and yards-to-go are indicated by information blocks 42. The initials for the two teams, the score, the team in possession of the football and the yard line that the ball is on are all indicated by the information blocks 42 through the windows 52, 52.

Figure 3:
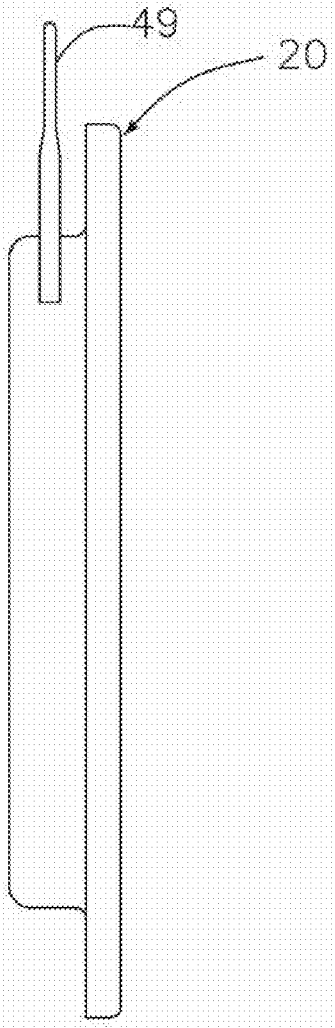
FIG. 3 is a left side view of the scoreboard shown in FIG. 1.

FIG. 3 shows a side profile of the scoreboard 20. The scoreboard has a slim profile for wall mounting, having a thickness T of 1 to 2 inches.

Figure 5:
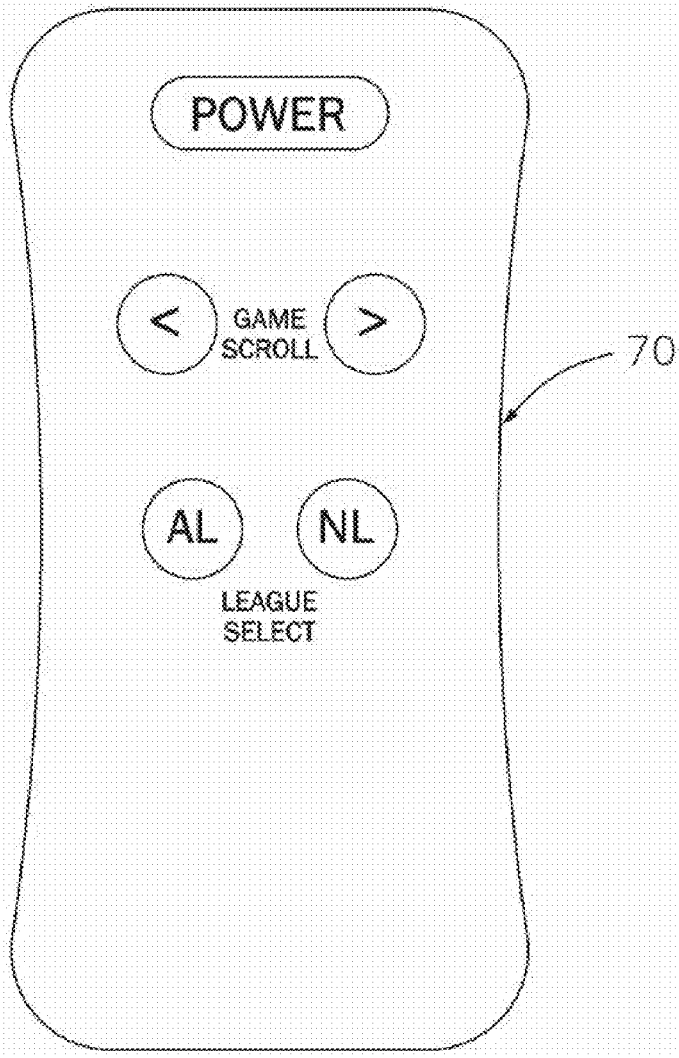
FIG. 5 is an elevation view of a remote-control unit used in conjunction with any of the previously described scoreboard embodiments.
Figure 4:
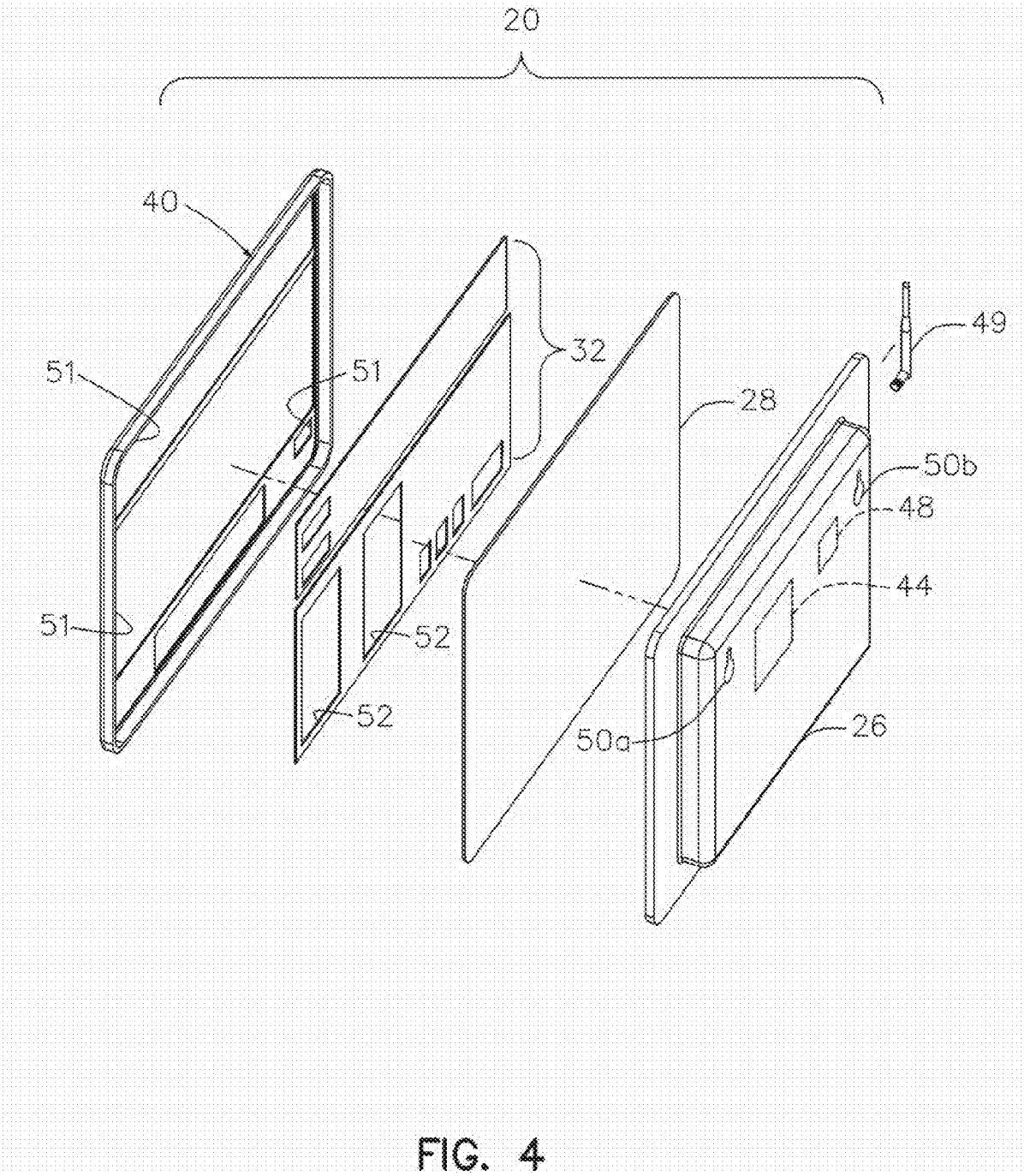
FIG. 4 is an exploded perspective view of the wall mounted scoreboard of FIG. 1.

FIG. 5 illustrate a simple remote-control 70 that can be used with the scoreboard 20 shown in FIGS. 1 and 3-5. A power button 72 turns the scoreboard 20 on or off. Left and right scroll buttons 74, 76 are used to select the game of interest. A left database button 78 selects American League games for display, and a right database button 80 selects the National League games for display. The remote control and corresponding scoreboard can be configured to operate on a conventional infrared system as is known.

Figure 6:
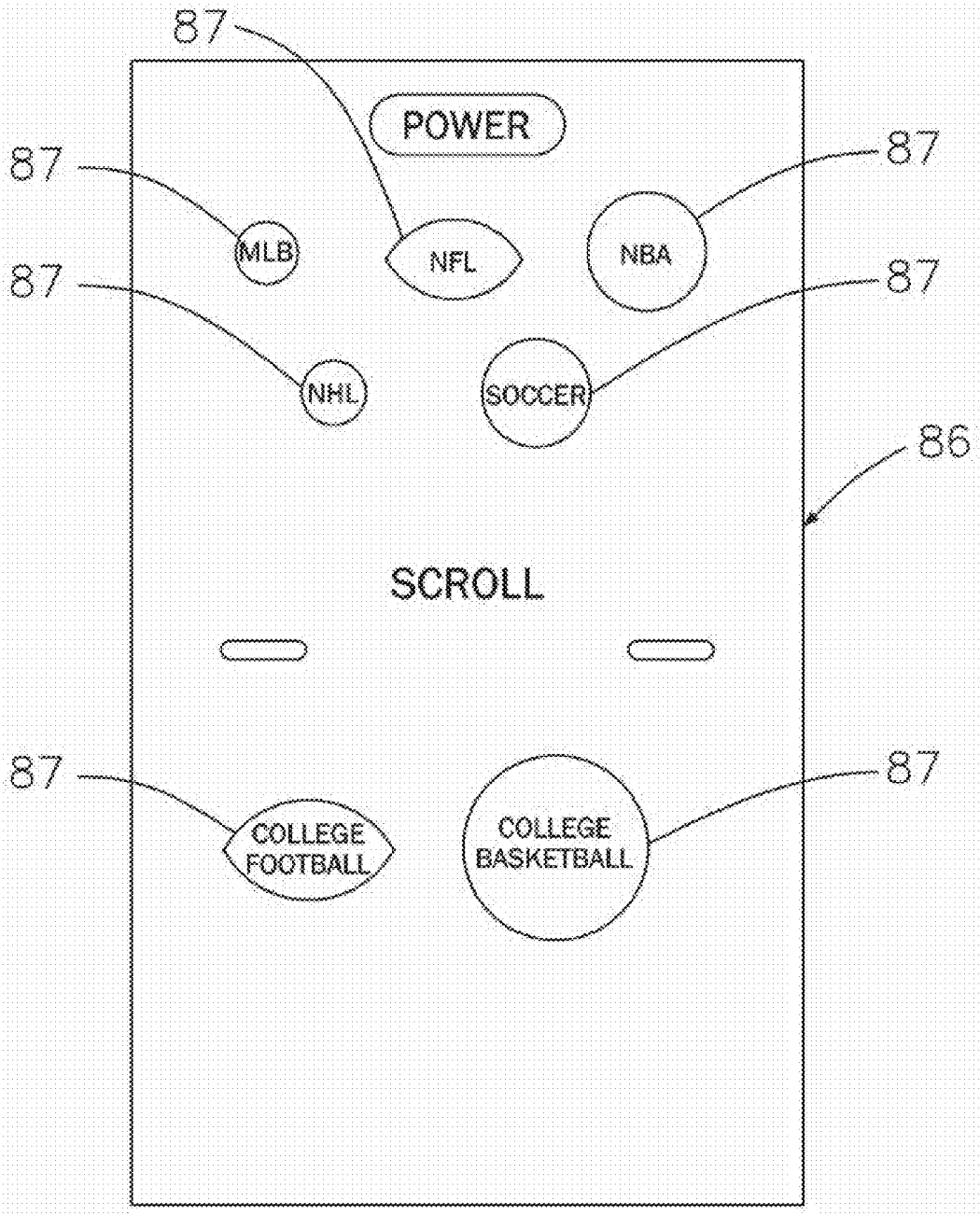
FIG. 6 is an elevation view of an alternate remote-control unit used in conjunction with any of the previously described scoreboard embodiment.

FIG. 6 illustrates an alternate remote control 86 that includes designated selection buttons 87 for switching the display panel 28 to indicate information blocks according to the selected league or sport. For added interest, the buttons 87 can be shaped according to the ball or puck of the selected sport. The remote control 86 can be used with any of the scoreboards described herein.

The scoreboard according to the invention can be powered by a plug-in wall outlet domestic power supply or can be battery-powered, preferably by lithium batteries. A battery backup can be provided for the scoreboard otherwise powered by a domestic power supply.

The wireless service provider that transmits the game information can charge the scoreboard user a subscription fee for reporting games of a particular team, or a package price for a league or multiple team subscription.

Figure 7:
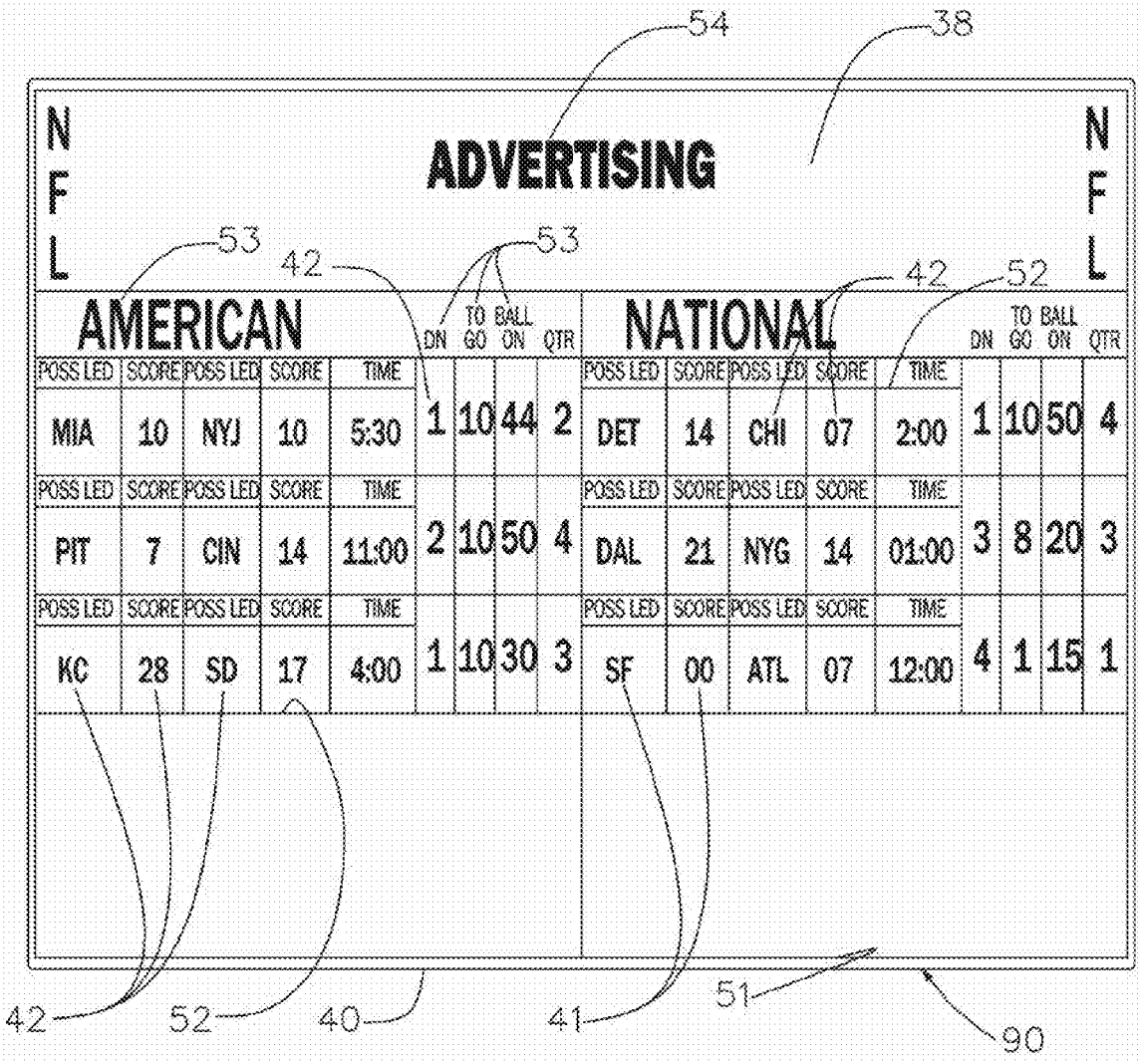
FIG. 7 is an elevation view of a further alternate embodiment wall mounted scoreboard according to the invention.

FIG. 7 illustrates a further embodiment wherein the scoreboard 90 that would display all current games for the dedicated fan who desires to know current game information throughout a league. The scoreboard would be constructed in the same manner as the scoreboard 20. This is particularly useful for sports betting and could be useful in a home, business establishment, or in a casino where sports betting occurs. The scoreboard could report game scores for professional sports, collegiate sports, etc.

Figure 8:
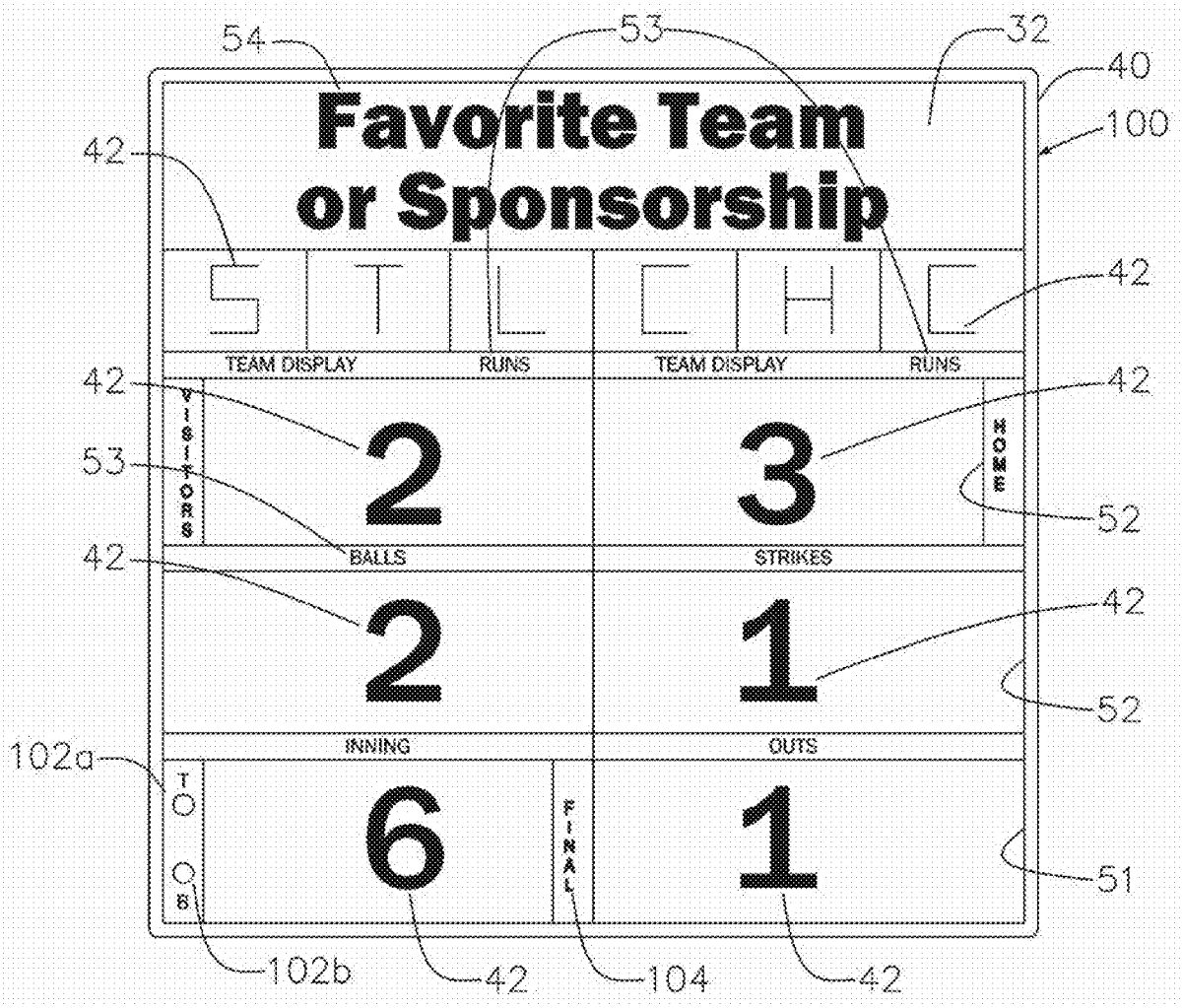
FIG. 8 is an elevation view of a portable scoreboard according to the invention.

FIG. 8 shows an alternate embodiment scoreboard 100 that is made as a handheld portable device. The scoreboard would be the approximate size of a large calculator and would display some or all of the information described, for example, in FIG. 1. The scoreboard would have dimensions L1 and H1 of approximately 5"×5" and be 1 to 2 inches thick. The scoreboard could be placed on a desk or on the dashboard of a car and would keep the dedicated fan current on the status of the selected game.

In all other respects, the structure the scoreboard 100 would be the same as the scoreboard 20 but with a simplified front display. The inning information blocks 42 would also include a top of the inning indicator 102*a*, a bottom of the in indicator 102*b*, and a game over or final score indicator 104. A surrounding frame 40 includes one or more windows 51 that allow information blocks 42 to be visible through windows 52 in the cover panel 32. The cover panel 32 includes graphics 53 to designate information blocks 42 and advertising graphics 54. The scoreboard 100 is preferably powered by rechargeable batteries, such as lithium batteries, that can be recharged by use of a recharger/adapter plugged into domestic power and plugged into a designated socket on the scoreboard 100, or by an automobile adapter/charger plugged into an automobile lighter socket and into a designated socket of the scoreboard 100.

Figure 9:
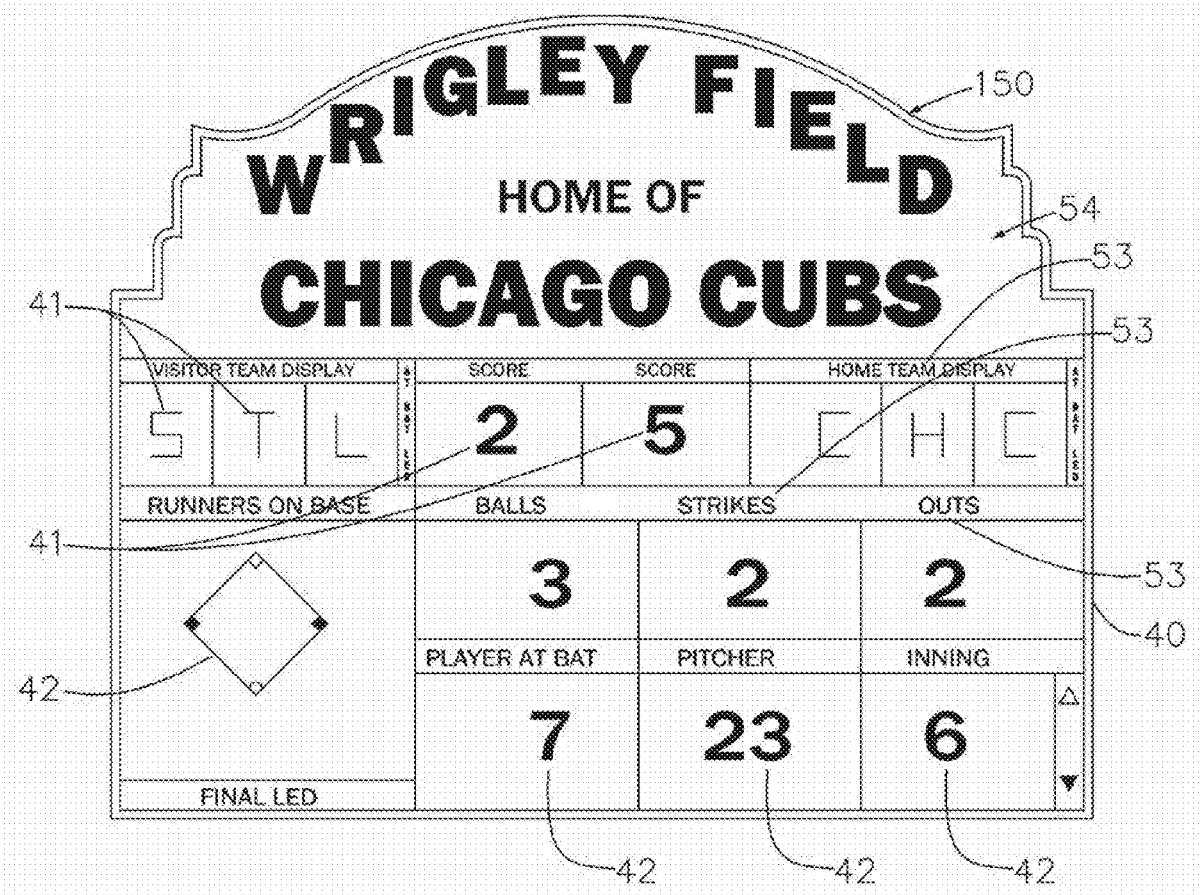
FIG. 9 is an elevation view of a further alternate embodiment wall mounted scoreboard according to the invention.

FIG. 9 illustrates a further embodiment wherein a scoreboard 150 is shaped and styled to be an authentic replica of a famous stadium scoreboard of the fan's favorite team. In the example shown in FIG. 9, the scoreboard 150, particularly the cover frame 40, is shaped like the famous scoreboard on the outside of Wrigley Field in Chicago. The overall dimensions L2 and H2 of this scoreboard are about 14 inches×12 inches. In all other respects, the structure the scoreboard 100 would be the same as the scoreboard 20.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A scoreboard sized and configured to be mounted on a wall, comprising:

a front face with visible information blocks comprised of LED or LCD alphanumeric displays;

a cover panel applied over said front face;

said cover panel includes openings that are in registry with the information blocks, wherein said cover panel includes graphics which display a designator for each information block, said designators corresponding to game data;

a control that is signal connected to said information blocks;

a communication link that is signal connected between said control and a remote game information provider, said communication link providing game information from a plurality of on going games to the control, the games being remotely located from the control, and the control providing game information to said information blocks from a user-selectable game of the plurality of games.

2. The scoreboard according to claim 1, wherein said communication link comprises a wireless link.

3. The scoreboard according to claim 1, wherein said communication link comprises a wired link.

4. The scoreboard according to claim 1, wherein said plurality of ongoing games are football games, and said information blocks include team identifiers, ball location, the current down, yards-to-go, team in possession of the ball, and score.

5. The scoreboard according to claim 1, wherein said plurality of ongoing games are baseball games, and said information blocks include team identifiers, score, balls, strikes, outs, and runners on base.

6. A wall mounted scoreboard sized and configured to be used in a home or commercial establishment, comprising:

a back cover having a front open face;

a cover panel applied over said front open face of said back cover;

a display panel interposed between said back cover and said cover panel, said display panel having changeable indicators arranged in information blocks, wherein said cover panel includes openings that are in registry with said information blocks, wherein said cover panel includes graphics which display a designator for each information block, said designators corresponding to game data;

a wireless receiver; a control, said wireless receiver receiving status information broadcast wirelessly from a remote game in progress and said control causing the display panel to display said status information thereon within said information blocks, said wireless receiver being of a type wherein a plurality of identical wireless receivers can all receive said status information broadcast remotely from the remote game in progress;

wherein said designators correspond to game data from plural ongoing games.

7. The wall mounted scoreboard according to claim 6, wherein said game is a baseball game, and said information blocks include team identifiers, score, balls, strikes, outs, and runners on base; and wherein said designators correspond to game data from plural ongoing baseball games.

8. The scoreboard according to claim 6, wherein said game is a football game, and said information blocks include team identifiers, ball location, the current down, yards-to-go, team in possession of the ball, and score; and wherein said designators correspond to game data from plural ongoing football games.

9. The wall mounted scoreboard according to claim 6 wherein said cover panel is removable and replaceable with a different cover panel having graphics for a game in a different sport.

10. The wall mounted scoreboard according to claim 6, wherein said back cover comprises mounting holes for hanging said scoreboard on a wall.

* * * * *